US010335852B2

(12) United States Patent
Larrea Lopez

(10) Patent No.: US 10,335,852 B2
(45) Date of Patent: Jul. 2, 2019

(54) SYSTEM AND METHOD FOR MOULDING METAL PARTS

(71) Applicant: AMPO S. COOP, Gipuzkoa (ES)

(72) Inventor: Unai Larrea Lopez, Gipuzkoa (ES)

(73) Assignee: AMPO S. COOP, Gipuzkoa (ES)

( * ) Notice: Subject to any disclaimer, the term of this patent is extended or adjusted under 35 U.S.C. 154(b) by 213 days.

(21) Appl. No.: 15/509,298

(22) PCT Filed: Jul. 1, 2015

(86) PCT No.: PCT/ES2015/070513
§ 371 (c)(1),
(2) Date: Mar. 7, 2017

(87) PCT Pub. No.: WO2016/050995
PCT Pub. Date: Apr. 7, 2016

(65) Prior Publication Data

US 2017/0282242 A1 Oct. 5, 2017

(30) Foreign Application Priority Data

Oct. 2, 2014 (ES) ..... 201431450

(51) Int. Cl.

| | |
|---|---|
| ***B22D 13/00*** | (2006.01) |
| ***B22C 9/04*** | (2006.01) |
| ***B22D 13/10*** | (2006.01) |
| ***B22C 1/00*** | (2006.01) |

(52) U.S. Cl.
CPC ..... *B22D 13/101* (2013.01); *B22C 1/00* (2013.01); *B22C 9/04* (2013.01); *B22D 13/00* (2013.01)

(58) Field of Classification Search
CPC ..... B22D 13/00; B22D 13/10; B22D 13/101; B22C 9/04
See application file for complete search history.

(56) References Cited

U.S. PATENT DOCUMENTS

| | | | | |
|---|---|---|---|---|
| 3,296,666 | A * | 1/1967 | Lirones | B22C 9/04 164/517 |
| 4,316,498 | A * | 2/1982 | Horton | B22C 1/165 106/38.9 |
| 4,655,276 | A * | 4/1987 | Bird | B22C 1/165 164/15 |
| 5,980,792 | A * | 11/1999 | Chamlee | B22D 13/04 164/69.1 |
| 9,533,348 | B2 * | 1/2017 | Satoh | B22D 13/10 |
| 2010/0018666 | A1 * | 1/2010 | Gigliotti | B22C 9/04 164/519 |
| 2012/0111224 | A1 * | 5/2012 | Tontrup | B22C 1/08 106/15.05 |

FOREIGN PATENT DOCUMENTS

| | | |
|---|---|---|
| GB | 467399 | 6/1937 |
| GB | 8151181 | 6/1959 |
| GB | 1221983 | 2/1971 |
| WO | WO199717150 | 5/1997 |

* cited by examiner

*Primary Examiner* — Kevin E Yoon
(74) *Attorney, Agent, or Firm* — Defillo & Associates; Evelyn A. Defillo

(57) ABSTRACT

A system and method for moulding metal parts having a first metal structure (4) which is integrally attached to a rotating machine, where said structure (4) is associated with a cover (3) and a plurality of fastening elements (1, 2), and where, in turn, the structure (4) is integrally attached to a cylindrical metal die (5) containing a ceramic mould (7) and hardened sand (6) for filling the die (5).

1 Claim, 1 Drawing Sheet

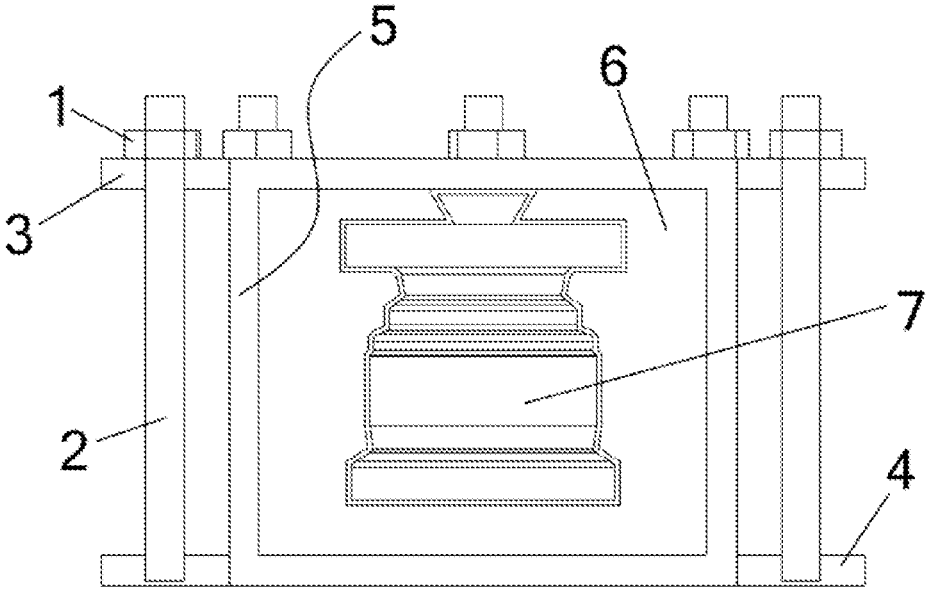
5
6
1
3
7
2
4

SYSTEM AND METHOD FOR MOULDING METAL PARTS

CROSS REFERENCE TO RELATED APPLICATION

This application is a national stage entry of PCT/ES2015/070513 filed Jul. 1, 2015, under the International Convention claiming priority over Spain Patent Application No. P201431450 filed Oct. 2, 2014.

TECHNICAL FIELD

The present invention relates to a system and method for moulding metal parts, the main advantage of which is based on the use of a die having mechanical properties that are good enough to withstand the demands of the centrifugal moulding of large-sized parts.

BACKGROUND OF THE PRIOR ART

When producing cast metal parts today, there are a number of methods known in the prior art that allow such production, such as, for example, sand moulding, ceramic moulding, centrifugal casting, etc., but said means have several drawbacks, particularly in relation to the mass production of different parts and the associated economic cost, as well as the need to have several hard-to-store moulds.

For example, sand moulding has the main drawback of being scarcely versatile as regards the design, which is a huge limitation when producing parts with a high degree of specification. This type of moulding furthermore has the additional drawback of requiring a wooden model for obtaining the sand mould of the part to be produced, meaning that the wooden model will be permanent. This requires having a given storage space and furthermore has to be made with a parting line, i.e., it must be made in two parts.

Furthermore, the possibility of sand getting into the part must be considered, which makes it necessary to trim away the excess material, etc., so said method generates a considerable cost increment when it is chosen as the means for producing the parts.

Another known example in the prior art is the use of a ceramic mould using polystyrene moulds injected onto an aluminium mould or the like, whereby avoiding having to store the moulds once they are used, providing more efficient solutions for machining and for moulding unitary parts.

Once the polystyrene mould is obtained, ceramic application step starts, in which the polystyrene mould is impregnated with ceramic material to subsequently be dried at a given temperature, and said operation can be repeated as many times needed, depending on the specific needs for producing the part.

Centrifugal casting is generally used for casting parts having a surface of revolution and a simple geometry (such as, for example, balls, tubes, etc.) by means of using metal dies, and it has endless advantages, among which it is necessary to point out that it reduces possible volume defects occurring while casting, that no process for removing excess material is required, and that it is a much more energy-efficient process than the other mentioned processes, but in turn it has the main drawback being scarcely versatile for producing parts with more complex geometries.

Example of methods for obtaining parts from moulds is international patent application WO9717150, which describes a method of preparing a shell mould for moulding hollow parts, in which a layer of refractory material is applied on a pattern of flexible elastically deformable material. A shell or die reproducing a negative of the pattern of the elastic mould is thereby obtained. Said mould is removed once said refractory layer is applied based on its deformability due to its elastic properties. Then pouring steel into said shell together with centrifugation will allow reproducing the hollow part that was initially intended to be moulded.

SUMMARY OF THE INVENTION

The technical problem that the present invention solves is that it makes a die having mechanical properties that are good enough to withstand the demands of the centrifugal moulding of large-sized parts. To that end, the system and method for moulding metal parts object of the present invention comprises a first metal structure or base which is integrally attached to a rotating machine, said machine rotating the assembly at a high speed, and where said structure is associated with a cover and with a plurality of fastening nuts and bolts, and where, in turn, the structure is integrally attached to a cylindrical metal die containing a ceramic mould and hardened sand for filling said die.

As a result of the method and system herein described, high-quality parts can be obtained with a low level of internal defects and/or impurities and no volume defects. Furthermore, highly versatile parts may be obtained because part design is not limited with the use of this method.

Once the dies have been used, they could be reused for producing other parts simply by applying ceramic materials on them, thereby reducing costs associated with the mould, and hence, with producing the parts.

Likewise, liquid shrinkage will gradually be offset with the material that is driven out by centrifugal force, so the incorporation of feed systems that increase the economic cost of making the part and that subsequently involve process for trimming away impurities, even further increasing the economic cost of the process of producing the part, is avoided.

Throughout the description and the claims the word "comprises" and variants thereof are not meant to exclude other technical features, additions, components or steps. For the persons skilled in the art, other objects, advantages and features of the invention will be inferred in part from the description and in part from putting the invention into practice. The following examples and drawings are provided by way of illustration and do not mean to restrict the present invention. Furthermore, the present invention covers all the possible combinations of particular and preferred embodiments herein indicated.

BRIEF DESCRIPTION OF THE DRAWINGS

A series of drawings that help to better understand the invention and which expressly relate to an embodiment of said invention provided as a non-limiting example thereof is very briefly described below.

FIG. 1 shows a view of a practical embodiment of the system for moulding metal parts, object of the present invention.

DETAILED DESCRIPTION OF THE INVENTION

The attached drawings show a preferred embodiment of the invention. More specifically, it comprises a first metal structure or base (4) which is integrally attached to a rotating machine, said machine rotating the assembly at a high speed, and where said structure (4) is associated with a cover (3) and with a plurality of fastening nuts (1) and bolts (2), and where, in turn, the structure is integrally attached to a cylindrical metal die (5) containing a ceramic mould (7) and hardened sand (6) for filling the die (5).

The method of moulding ceramic parts includes:

i) In a first step, producing a polystyrene model of the part to be produced; said model can be produced by injecting polystyrene onto an aluminium mould in the event of mass production of parts, or by means of machining a polystyrene block from a polystyrene block for producing unitary parts.

ii) In a second step, introducing the polystyrene model in a liquid ceramic "Milled Zircon®" (zirconium sand) and "Primcote®" (a binder) mixture until the model is fully impregnated.

iii) In a third step, coating the impregnated model with a layer of zirconium sand.

iv) Subsequently introducing the obtained part in a drying oven for about thirty minutes at 30° C.

v) Then, once the part is taken out of the oven, applying a liquid layer of a ceramic mixture made up of "Fascote Binder®" (silica binder) and "Fascote Refractary®" (silicon dioxide).

vi) Coating the part with a "Molochite®" type (kaolin) ceramic material.

vii) Introducing the part in a drying oven for about 45 minutes at a temperature of 50° C.

viii) Repeating steps vi) and vii) until the part obtains a ceramic thickness of between 10 and 15 millimeters.

ix) Introducing the part in a high-temperature oven for about an hour at a temperature of 1050° C. so that the polystyrene becomes volatile, obtaining the ceramic mould (7).

x) Attaching the mould (7) to the die (5) inside the latter and adding hardened sand (6).

xi) Fixing the structure or base (4) to the centrifuging machine and casting the molten metal at a variable rate depending on the particular needs of each part, obtaining the final metal part.

The invention claimed is:

1. A method for moulding metal parts, the method comprising the steps of:

a) making a polystyrene model of a metal part;

b) impregnating the polystyrene model with a liquid zirconium sand and binder mixture;

c) coating the polystyrene model with zirconium sand;

d) introducing the polystyrene model in a drying oven for about thirty minutes at 30° C.;

e) applying a liquid layer of a silica and silicon dioxide binder mixture to the polystyrene model;

f) coating the polystyrene model with kaolin;

g) introducing the polystyrene model in a drying oven for about 45 minutes at 50° C.;

h) repeating steps f) and g) until the polystyrene model obtains a ceramic thickness of between 10 and 15 millimeters;

i) introducing the polystyrene model in a high-temperature oven for about an hour at a temperature of 1050° C. until the polystyrene becomes volatile and a ceramic mould (7) is obtained;

j) attaching the mould (7) to a die (5) inside the latter and adding hardened sand (6); and k) attaching the die (5) to a structure or base (4), and attaching the structure or base to a centrifuging machine and casting a molten material.

* * * * *